US011840066B2

(12) United States Patent
Nishikawa

(10) Patent No.: US 11,840,066 B2
(45) Date of Patent: Dec. 12, 2023

(54) IMAGE RECORDING APPARATUS HAVING CUTTER TO BE EASILY REPLACED

(71) Applicant: BROTHER KOGYO KABUSHIKI KAISHA, Nagoya (JP)

(72) Inventor: Yasuo Nishikawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/813,699

(22) Filed: Jul. 20, 2022

(65) Prior Publication Data

US 2023/0101267 A1 Mar. 30, 2023

(30) Foreign Application Priority Data

Sep. 30, 2021 (JP) ..... 2021-160363

(51) Int. Cl.
*B41J 11/66* (2006.01)
*B41J 15/04* (2006.01)

(52) U.S. Cl.
CPC ..... *B41J 11/66* (2013.01); *B41J 15/04* (2013.01)

(58) Field of Classification Search
None
See application file for complete search history.

(56) References Cited

U.S. PATENT DOCUMENTS

2016/0214406 A1* 7/2016 Kato et al. ..... B65H 33/18
2017/0157957 A1* 6/2017 Williams et al. ..... B41J 11/663
2019/0359444 A1* 11/2019 Eoka et al. ..... G07F 19/209
2021/0122174 A1 4/2021 Tanaka et al.
2021/0300084 A1* 9/2021 Takahashi ..... B41J 13/0045
2022/0184979 A1* 6/2022 Fukasawa et al. ..... B41J 11/706

FOREIGN PATENT DOCUMENTS

JP 2002160409 A * 6/2002
JP 2020-11393 A 1/2020

* cited by examiner

*Primary Examiner* — Leslie J Evanisko
(74) *Attorney, Agent, or Firm* — Merchant & Gould P.C.

(57) ABSTRACT

An image recording apparatus includes an operation panel, a sheet conveyor, a print head, a cutting device, and a sheet discharge port. The operation panel is disposed at a first-side face of a housing in a particular direction that extends from a first side to a second side of the image recording apparatus. The sheet conveyor is configured to convey a sheet along a conveyance path in a conveyance direction. The print head is disposed downstream of the sheet conveyor in the conveyance direction. The cutting device has a cutter for cutting the sheet. The sheet discharge port is open at the first-side face of the housing. At least a part of the sheet passes through the sheet discharge port when the sheet is discharged from the conveyance path. The cutter positioned below the operation panel is exposed to an outside of the housing through the sheet discharge port.

7 Claims, 7 Drawing Sheets

IMAGE RECORDING APPARATUS HAVING CUTTER TO BE EASILY REPLACED

REFERENCE TO RELATED APPLICATIONS

This application claims priority from Japanese Patent Application No. 2021-160363 filed on Sep. 30, 2021. The entire content of the priority application is incorporated herein by reference.

BACKGROUND ART

As an image recording apparatus having a cutter for cutting a sheet, a printing apparatus has been known that includes a cutter configured to cut a medium printed by a print engine. The cutter includes a cutter unit configured to cut the printed medium discharged from a passing port of a casing. The cutter unit is disposed in an internal space of a projected part, which is a forward-protruding portion of the casing, below an operation panel. The passing port is located at a front face of the projected part of the casing. An exposure port is formed at a distance leftward from the passing port. The exposure port is open forward and upward. The internal space of the projected part is exposed to the outside through the exposure port. The exposure port is closed by a cover. When the cover is opened to expose the exposure port, a user is allowed to replace a blade of the cutter unit through the exposure port.

DESCRIPTION

In the known printing apparatus, since the blade is disposed in the internal space of the projected part that protrudes forward from the casing, it is possible to replace the blade safely. However, in such a configuration that the exposure port is exposed when the cover is opened, there is a problem that replacement of the blade is troublesome.

Aspects of the present disclosure are advantageous to provide one or more improved techniques for an image recording apparatus that make it possible to easily replace a cutter in a housing.

According to aspects of the present disclosure, an image recording apparatus is provided, which includes a housing, an operation panel, a sheet conveyor, a print head, a cutting device, and a sheet discharge port. The operation panel is disposed at a first-side face of the housing. The first-side face is a surface on a first side of the housing in a particular direction. The particular direction extends from the first side to a second side of the image recording apparatus. The sheet conveyor is configured to convey a sheet along a conveyance path in a conveyance direction. The print head is disposed downstream of the sheet conveyor in the conveyance direction. The print head is configured to eject print liquid onto the sheet. The cutting device has a cutter disposed below the operation panel. The cutter is configured to cut the sheet. The sheet discharge port is open at the first-side face of the housing. At least a part of the sheet passes through the sheet discharge port when the sheet is discharged from the conveyance path. The cutter positioned below the operation panel is exposed to an outside of the housing through the sheet discharge port.

FIG. 1 is an external perspective view of an image recording apparatus.

FIG. 2 schematically shows a configuration of the image recording apparatus.

FIG. 3 schematically shows different states of a rotatable rib.

Figure 7:
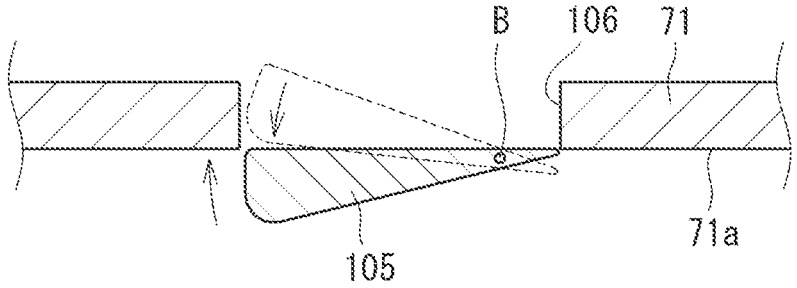
Figure 7:
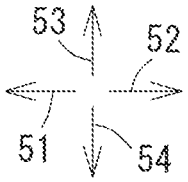

FIG. 7 schematically shows different states of a rotatable rib.

Figure 8:
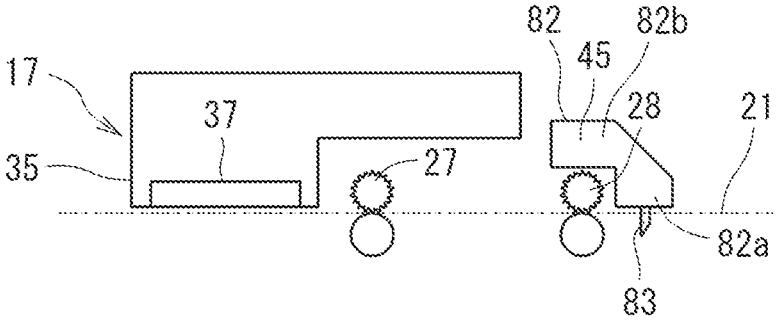
Figure 8:
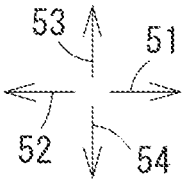

FIG. 8 is a side view schematically showing a part, including a cutting device disposed in front of discharge rollers, of the image recording apparatus.

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings. It is to be understood, needless to say, that the illustrative embodiment described below is merely one example in which aspects of the present disclosure are embodied and that aspects of the present disclosure are capable of use in various other combinations and environments and are capable of changes or modifications within the scope of the inventive concept as expressed herein. In the following description, a direction in which an opening 13 is open in a print engine 11 will be defined as a frontward direction 51. An opposite direction of the frontward direction 51 will be defined as a rearward direction 52. The frontward direction 51 and the rearward direction 52 together may be referred to as front-rear directions 51 and 52. Upward and downward directions orthogonal to the front-rear directions 51 and 52 may be referred to as vertical directions 53 and 54. Directions orthogonal to the front-rear directions 51 and 52 and the vertical directions 53 and 54 may be referred to as left-right directions 55 and 56. An upward one of the vertical directions 53 and 54 will be defined as an upward direction 53. A downward one of the vertical directions 53 and 54 will be defined as a downward direction 54. When an image recording apparatus 10 is viewed in the rearward direction 52 (i.e., when the image recording apparatus 10 is viewed from the front), a leftward one of the left-right directions 55 and 56 will be defined as a leftward direction 55. In this case, a rightward one of the left-right directions 55 and 56 will be defined as a rightward direction 56.

Figure 1:
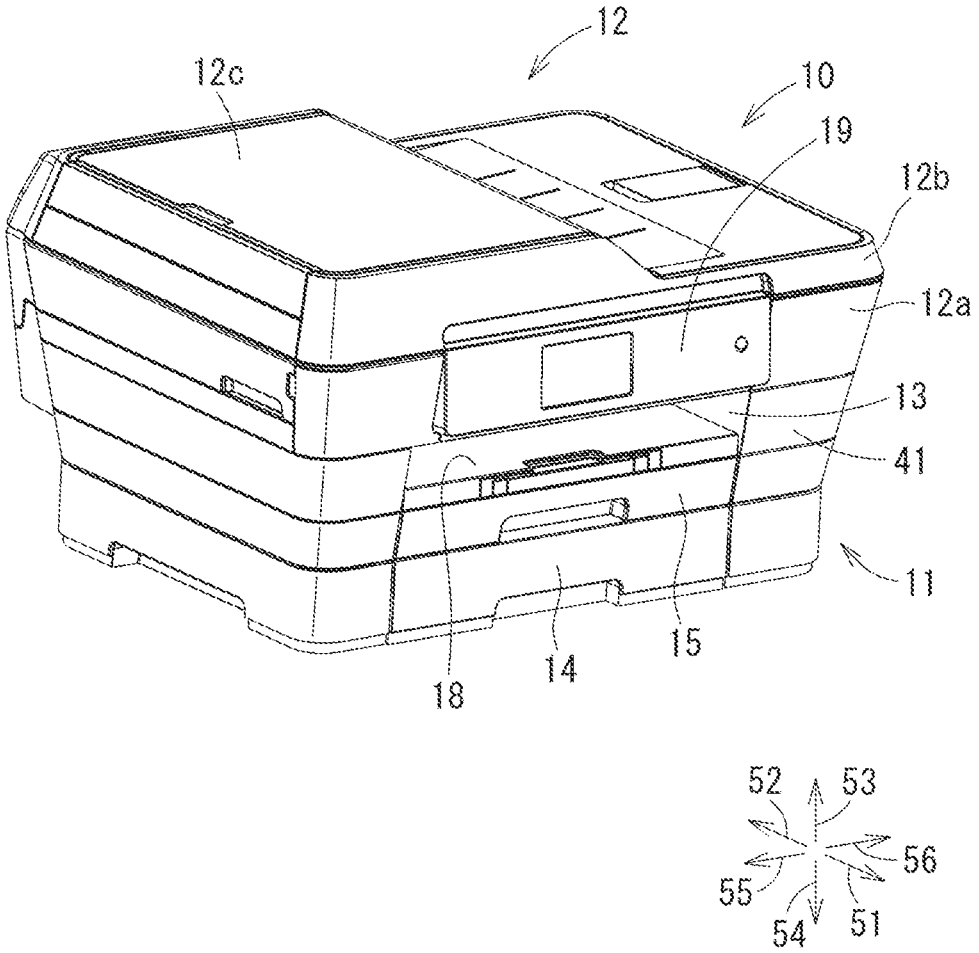

As shown in FIG. 1, the image recording apparatus 10 is a multi-function peripheral integrally provided with the print engine 11 and a scan engine 12. The print engine 1I is disposed at a lower portion of the image recording apparatus 10. The scan engine 12 is disposed at an upper portion of the image recording apparatus 10. The image recording apparatus 10 has a printing function, a scanning function, a copy function, and a facsimile function. The image recording apparatus 10 does not necessarily have the scan engine 12, and may be a single-function printer without the scanning function or the copy function.

The image recording apparatus 10 is mainly used in connection with an external information device (not shown) such as a computer. The print engine 11 is configured to record an image on a recording sheet 16 based on print data received from the external information device or on image data of a document scanned by the scan engine 12.

The scan engine 12 is located above the print engine 11. The scan engine 12 is a so-called flatbed scanner. The scan engine 12 includes a scanner body 12*a* disposed above the print engine 11, and a document cover 12*b* disposed above the scanner body 12*a*. On an upper surface of the scanner body 12*a*, a platen glass (not shown) is disposed on which a document sheet is placed. Inside the scanner body 12*a*, an image sensor (not shown) is disposed that is configured to optically read an image of the document placed on the platen glass. The document cover 12*b* includes an ADF ("ADF" is an abbreviation for "Automatic Document Feeder") 12*c* that is configured to pick up and feed, on a sheet-by-sheet basis, a plurality of document sheets to be scanned.

Print Engine

A configuration of the print engine 11 will be described below with reference to FIGS. 1 to 4. It is noted that in FIG. 2, a sheet feed cassette 14 is not shown for the sake of simplified explanation.

Figure 2:
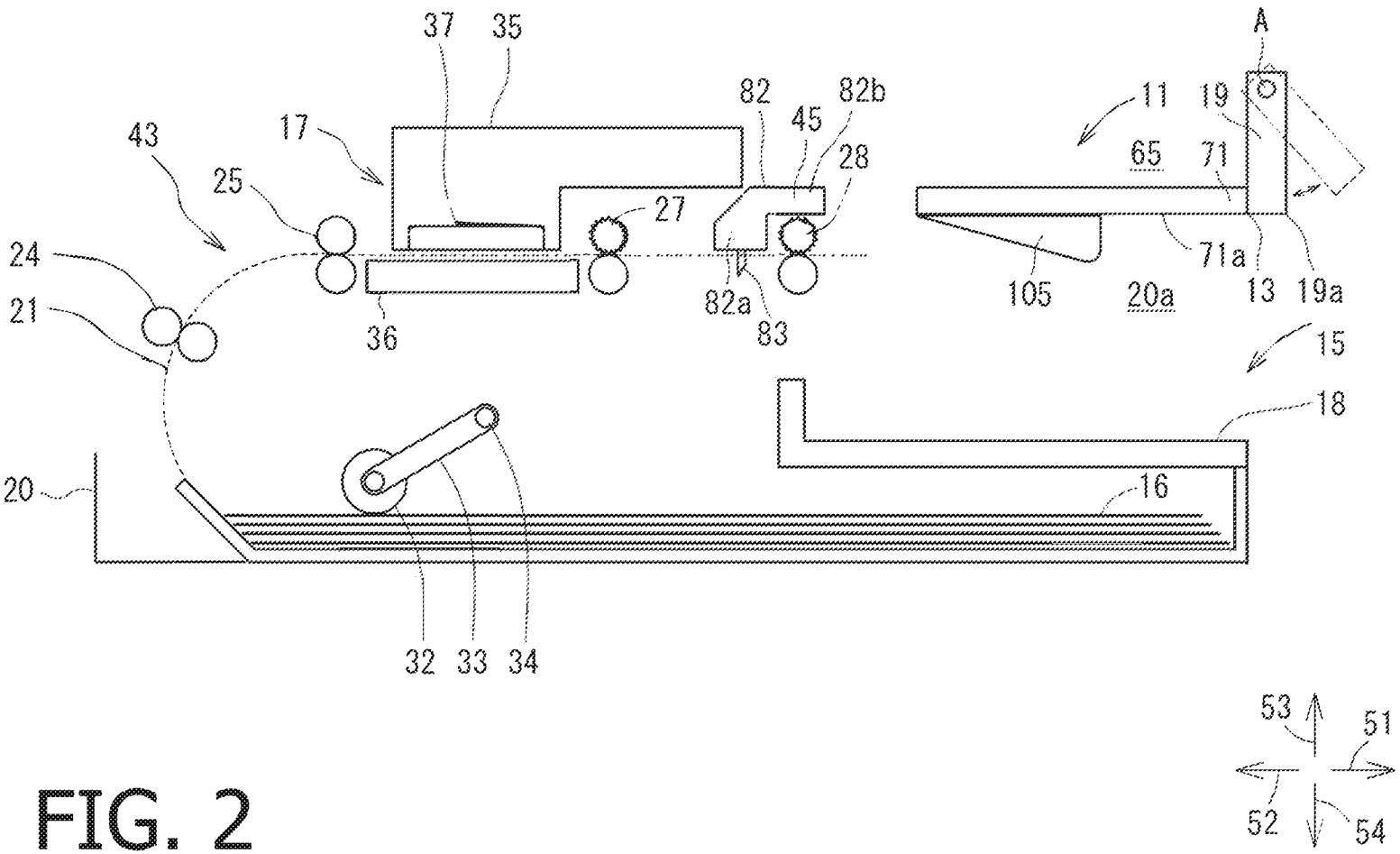

As shown in FIGS. 1 and 2, the print engine 11 has a housing 20. The housing 20 contains therein the sheet feed cassette 14, a sheet feed cassette 15, a recording device 17, a cutting device 45, and other functional elements. An operation panel 19 is disposed on a front face of the housing 20.

The operation panel 19 is formed in a flat plate shape. A front surface of the operation panel 19 has a rectangular shape with a longitudinal direction along the left-right directions 55 and 56. The operation panel 19 is located at a central portion of the front face of the housing 20 in the left-right directions 55 and 56. An upper end of the operation panel 19 is located near an upper end of the front face of the housing 20. A lower end 19*a* of the operation panel 19 is located above a middle position of the front face of the housing 20 in the vertical directions 53 and 54. The front face of the operation panel 19 faces forward (i.e., faces in the frontward direction 51). The operation panel 19 is configured to rotate about an axis A extending along the left-right directions 55 and 56. The axis A is located at an upper portion of the operation panel 19. The operation panel 19 is rotatable from a position where the front face faces in the frontward direction 51 to a position where the front face faces in the upward direction 53 and the frontward direction 51. On the front surface of the operation panel 19, a display and input keys are provided. The display is configured to display thereon various types of information. The input keys are configured to receive input of information. The image recording apparatus 10 is configured to operate based on instruction information input via the operation panel 19 or instruction information sent by the external information device through a printer driver or a scanner driver.

An opening 13 is disposed below the operation panel 19 on the front face of the housing 20. The opening 13 is located substantially at the central portion of the front face of the housing 20 in the left-right directions 55 and 56. The opening 13 is formed in a rectangular shape with a longitudinal direction along the left-right directions 55 and 56. The opening 13 extends from the lower end 19*a* of the operation panel 19 to the lower end of the housing 20.

The housing 20 has an internal space 20*a* extending backward from the opening 13. A rear portion of the internal space 20*a* is communicated with an after-mentioned conveyance path 21. The internal space 20*a* extends from an upper wall 71 to the lower end of the housing 20. The upper wall 71 extends in the rearward direction 52 from an upper end of the opening 13. A lower surface 71*a* of the upper wall 71 defines an upper surface of the internal space 20*a*. The upper wall 71 separates aboard housing space 65 from the internal space 20*a*. The board housing space 65 is disposed rearward of the operation panel 19. The board housing space 65 contains therein a board (not shown) on which one or more electronic circuits electrically connected with the operation panel 19 are mounted.

The upper wall 71 has a rib 105 protruding downward from the lower surface 71*a*. The ribs 105 is formed in a flat plate shape extending in the front-rear directions 51 and 52 and the vertical directions 53 and 54. The rib 105 is formed in such a manner that a downward-protruding amount of the rib 105 increases in the frontward direction 51. The rib 105 extends forward from a position close to a downstream end of the after-mentioned conveyance path 21 to substantially a middle position of the upper wall 71 in the front-rear directions 51 and 52.

Figure 3:
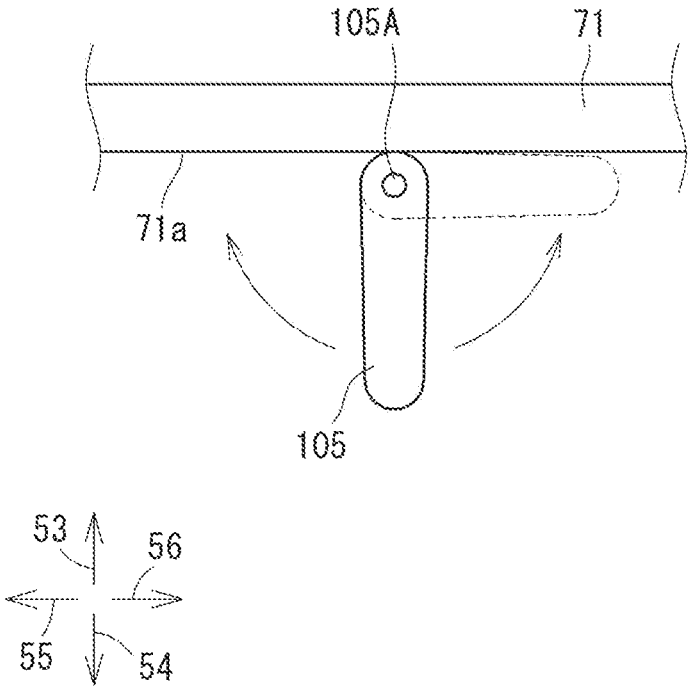

As shown in FIG. 3, the rib 105 is attached to the lower surface 71*a* of the upper wall 71, to be rotatable about an axis 105A extending in the front-rear directions 51 and 52. Thereby, the rib 105 is movable to a hanging position where the rib 105 hangs downward by gravity and to a contact position where the rib 105 is brought into contact with the lower surface 71*a* of the upper wall 71 after rotating about the axis 105A from the hanging position. For instance, the rib 105 may be held in the hanging position by a torsion spring (not shown). In this case, the rib 105 may be configured to rotate toward the contact position against an elastic force of the torsion spring when a force is applied in such a direction as to rotate the rib 105 about the axis 105A. The structure of the rib 105 is not limited to a particular structure as long as a lower end of the rib 105 is movable higher than the hanging position. The number of the rib(s) 105 is not limited. For instance, two or more ribs 105 may be arranged spaced apart from each other in the left-right directions 55 and 56. The rib 105 may not be rotatable. The rib 105 may be omitted.

Figure 4:
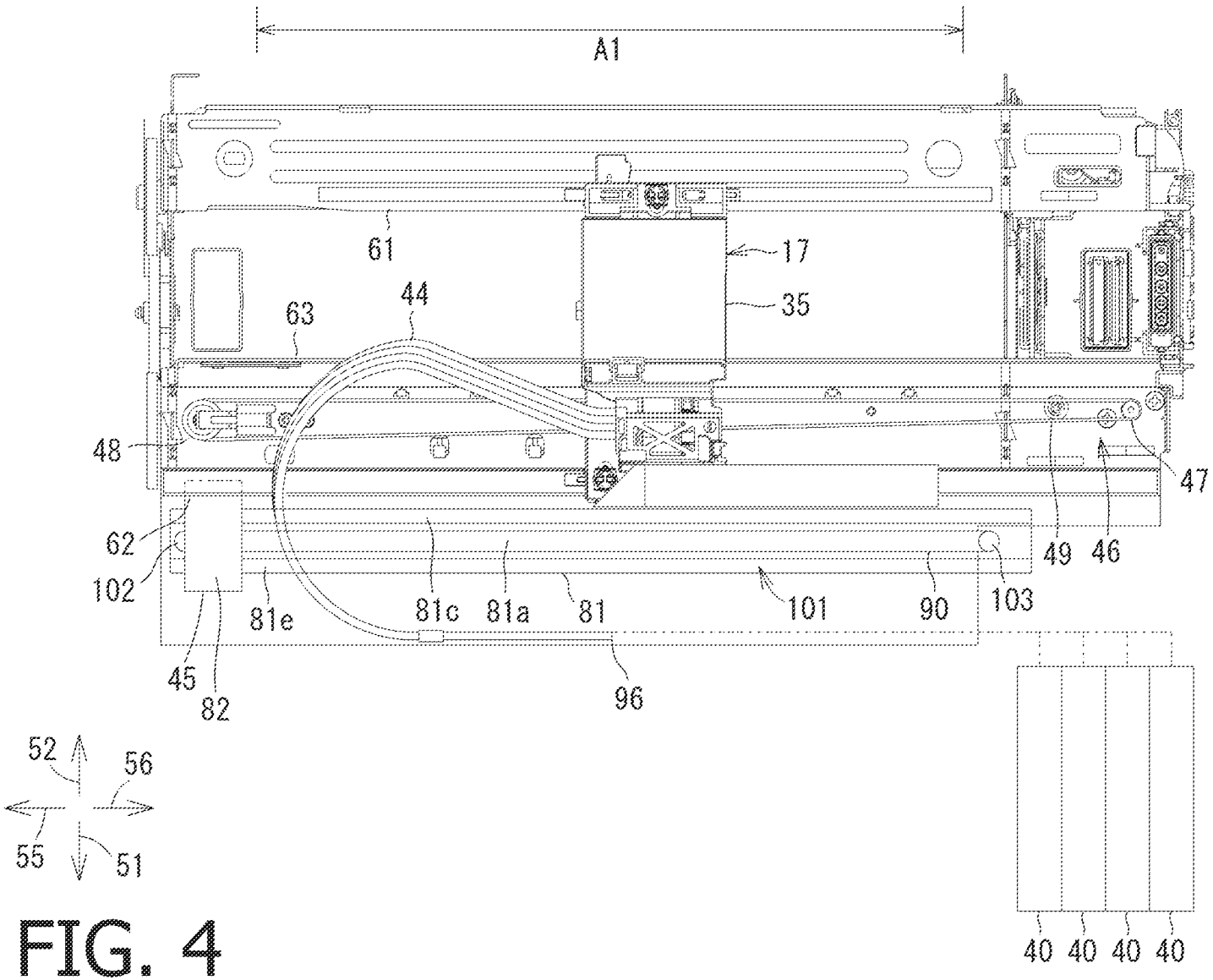
FIG. 4 is a plan view showing an internal configuration of the image recording apparatus.

As shown in FIG. 1, on the front face of the housing 20, an opening/closing cover 41 is attached to the right of the opening 13. When the opening/closing cover 41 is opened, a cartridge attachment space is opened. Thus, ink cartridges 40 to store ink are allowed to be attached to or removed from the housing 20. As shown in FIGS. 2 and 4, the ink cartridges 40 are positioned in front of the recording device 17 in the housing 20. In the illustrative embodiment, four ink cartridges 40 that store four types of ink having respective different colors are attachable to the housing 20. Each ink cartridge 40 is configured to, when attached to the housing 20, supply ink to a recording head 37 of the recording device 17 through a tube 44. The tubes 44 will be described later in detail.

As shown in FIG. 1, the sheet feed cassettes 14 and 15 are attached to the housing 20 in a state where the sheet feed cassettes 14 and 15 are inserted into the opening 13. The sheet feed cassettes 14 and 15 are configured to be inserted into and pulled out of the housing 20 along the front-rear directions 51 and 52. Thus, the sheet feed cassettes 14 and 15 are removably attachable to the housing 20. The sheet feed cassette 14 is, when attached to the housing 20, is positioned below the sheet feed cassette 15. As shown in FIG. 2, the sheet feed cassette 15 is configured to hold a stack of standard-form recording sheets 16 set therein. Examples of the standard form of the recording sheets 16 may include, but are not limited to, A3 size, A4 size, and B5 size in the Japanese Industrial Standards. A sheet discharge tray 18 is disposed above the sheet feed cassette 15. The sheet discharge tray 18 is configured to support recording sheets 16 discharged from the conveyance path 21. In the illustrative embodiment, the two types of sheet feed cassettes 14 and 15 are provided. However, the sheet feed cassette 14 may be omitted.

The sheet feed cassette 15 is configured to hold a plurality of recording sheets 16. The sheet feed cassette 15 is formed in the shape of a container a part of which is open at the rear side (i.e., the left side in FIG. 2) of the image recording apparatus 10. The recording sheets 16 are held in a stacked state in an internal space of the sheet feed cassette 15. The sheet discharge tray 18 disposed above the sheet feed cassette 15 is formed on the front face side (i.e., the right side in FIG. 2) of the image recording apparatus 10. FIG. 2 shows the sheet feed cassette 15 inserted into the housing 20.

As shown in FIG. 2, in the housing 20, a sheet conveyor 43 is disposed that is configured to convey a recording sheet 16 along the conveyance path 21 from the sheet feed cassette 15 to the sheet discharge tray 18. The conveyance path 21 is a so-called U-turn path that extends upward from the sheet feed cassette 15, then curves to make a U-turn toward the front, and further extends straight in the frontward direction 51 toward the sheet discharge tray 18. A downstream end of the conveyance path 21 is communicated with the internal space 20*a*.

The sheet conveyor 43 includes a pick-up roller 32, two intermediate rollers 24, two PF rollers 25, two first discharge rollers 27, and two second discharge rollers 28. Along the conveyance path 21, the above rollers 32, 24, 25, 27, and 28 are disposed in the aforementioned order from the upstream side in a conveyance direction from the sheet feed cassette 15 to the sheet discharge tray 18.

The pick-up roller 32 is disposed above the sheet feed cassette 15. The pick-up roller 32 is provided at a distal end portion of an arm 33. The pick-up roller 32 is rotatable with the left-right direction 55, 56 as a direction of axis. A base end portion of the arm 33 is rotatable about a shaft 34. When the arm 33 rotates, the sheet feed roller 32 moves in such a direction that the pick-up roller 32 is brought into contact with or separated from the sheet feed cassette 15. The arm 33 is rotated toward the sheet feed cassette 15 by the weight of the pick-up roller 32. Thereby, the pick-up roller 32 is brought into contact with a topmost recording sheet 16 of a plurality of recording sheets 16 stacked in the sheet feed cassette 15. When the sheet feed roller 32 rotates in this state, the topmost recording sheet 16 is fed from the sheet feed cassette 15 to the conveyance path 21.

The intermediate rollers 24 are disposed at a curved portion of the conveyance path 21. The intermediate rollers 24 are rotatable with the left-right direction 55, 56 as a direction of axis. The intermediate rollers 24 are configured to rotate by a driving force transmitted from a motor (not shown). The recording sheet 16 fed from the sheet feed cassette 15 to the conveyance path 21 is pinched between the intermediate rollers 24 and conveyed toward the PF rollers 25.

The PF rollers 25 are located near a downstream end of the curved portion of the conveyance path 21 in the conveyance direction. The PF rollers 25 are rotatable with the left-right direction 55, 56 as a direction of axis. The PF rollers 25 are configured to rotate by a driving force transmitted from a motor (not shown). The recording sheet 16 conveyed by the intermediate rollers 24 is pinched between the PF rollers 25 and conveyed toward under the recording head 37.

The first discharge rollers 27 and the second discharge rollers 28 are disposed downstream of the recording head 37 in the conveyance direction, along the conveyance path 21. The first discharge rollers 27 are located upstream of the second discharge rollers 28 in the conveyance direction. The first discharge rollers 27 and the second discharge rollers 28 are configured to rotate by a driving force transmitted from a motor (not shown). The recording sheet 16 conveyed by the PF rollers 25 is pinched between the first discharge rollers 27 and pinched between the second discharge rollers 28, and is conveyed onto the sheet discharge tray 18.

As shown in FIG. 2, the recording device 17 is disposed between the PF rollers 25 and the first discharge rollers 27, along the conveyance path 21. Namely, the recording device 17 is located downstream of the PF rollers 25 and upstream of the first discharge rollers 27 in the conveyance direction. The recording device 17 includes a carriage 35, a platen 36, and the recording head 37. The carriage 35 is located above the conveyance path 21. The platen 36 is located below the conveyance path 21. The recording head 37 is mounted on the carriage 35. A configuration of the carriage 35 will be described later in detail.

As shown in FIG. 4, the recording head 37 is a so-called inkjet head configured to be supplied with ink of each color of cyan (C), magenta (M), yellow (Y), and black (Bk) from the ink cartridges 40 through the tubes 44, and to eject the ink of each color as ink droplets. The recording device 17 is configured to perform image recording on the recording sheet 16 being conveyed on the platen 36 by ejecting ink droplets from the recording head 37 while the carriage is reciprocating along the left-right directions 55 and 56.

As shown in FIG. 4, the carriage 35 is supported by guide frames 61 and 62. The guide frames 61 and 62 are spaced apart from each other in the front-rear directions 51 and 52. Each of the guide frames 61 and 62 extends along the left-right directions 55 and 56. The carriage 35 is mounted straddling the guide frames 61 and 62, to be movable in a reciprocating manner along the left-right directions 55 and 56. The guide frame 61 located rearward of the guide frame 62 is formed in the shape of a flat plate longer than a reciprocating range of the carriage 35 in the left-right directions 55 and 56. An upper surface of the guide frame 61 slidably supports a rear end portion of the carriage 35.

The guide frame 62 located in front of the guide frame 61 is formed in the shape of a flat plate that is substantially as long as the guide frame 61 in the left-right directions 55 and 56. The guide frame 62 has an edge section 63 configured to support a front end portion of the carriage 35. The edge section 63 is bent upward substantially at a right angle. The carriage 35 is slidably supported on an upper surface of the guide frame 62. The carriage 35 pinches the edge section 63 by rollers (not shown). Thus, the carriage 35 is slidably supported on the guide frames 61 and 62. The carriage 35 is movable in a reciprocating manner along the left-right directions 55 and 56, on the basis of the edge section 63 of the guide frame 62.

A belt drive mechanism 46 is disposed on the upper surface of the guide frame 62. The belt drive mechanism 46 includes a first pulley 47, a second pulley 48, and a ring-shaped endless belt 49. The first pulley 47 and the second pulley 48 are disposed near two ends of the conveyance path 21 in the left-right directions 55 and 56, respectively. The ring-shaped endless belt 49 has teeth provided on an inner circumference thereof. Thus, the belt drive mechanism 46 is configured with the ring-shaped endless belt 49 being wound around the first and second pulleys 47 and 48. The first pulley 47 and the second pulley 48 are located at two ends of the range within which the carriage 35 reciprocates in the left-right directions 55 and 56. The first pulley 47 is configured to rotate in response to a driving force being transmitted from a CR motor (not shown) as a driving source to a shaft of the first pulley 47. The rotation of the first pulley 47 causes the belt 49 to make a circulating movement. At this time, the second pulley 48 is driven to rotate by the circulating movement of the belt 49. Examples of the belt 49 may include, but are not limited to, a belt of which two ends are fixedly attached to the carriage 35, as well as the endless belt as shown in FIG. 4.

The carriage 35 is fixedly connected with the belt 49. Although a joint portion between the carriage 35 and the belt 49 is not shown in detail in any drawing, the belt 49 is slightly pulled upward when connected with the carriage 35. Thereby, a tension for elastically returning downward is generated in the belt 49. By the tension, the carriage 35 is elastically urged against the guide frames 61 and 62. As described above, when the belt 49 makes a circulating movement, the carriage 35 reciprocates on the guide frames 61 and 62 on the basis of the edge section 63. Thus, the recording head 37, which is mounted on the carriage 35, is movable in a reciprocating manner with the left-right direction 55, 56 as a main scanning direction.

Each tube 44 is a synthetic resin tube, and has flexibility to bend according to the reciprocating movement of the carriage 35. In the illustrative embodiment, four tubes 44 are provided corresponding to the four ink cartridges 40. One end of each tube 44 is connected with a case (not shown) in which the ink cartridges 40 are set. The other end of each tube 44 is connected with the recording head 37 on the carriage 35. Between the carriage 35 and the ink cartridges 40 in the front-rear directions 51 and 52, each tube 44 extends leftward from the carriage 35, then curves to make a U-turn toward the right, further extends rightward, and is connected with the housing 20 at a fixed location 96. The tubes 44 are disposed as appropriate from the fixed location 96 to the case of the ink cartridges 40. In response to the movement of the carriage 35 along the left-right directions 55 and 56, each tube 44 follows the carriage 35 while changing its U-turn-curved shape.

Cutting Device

Figure 6:
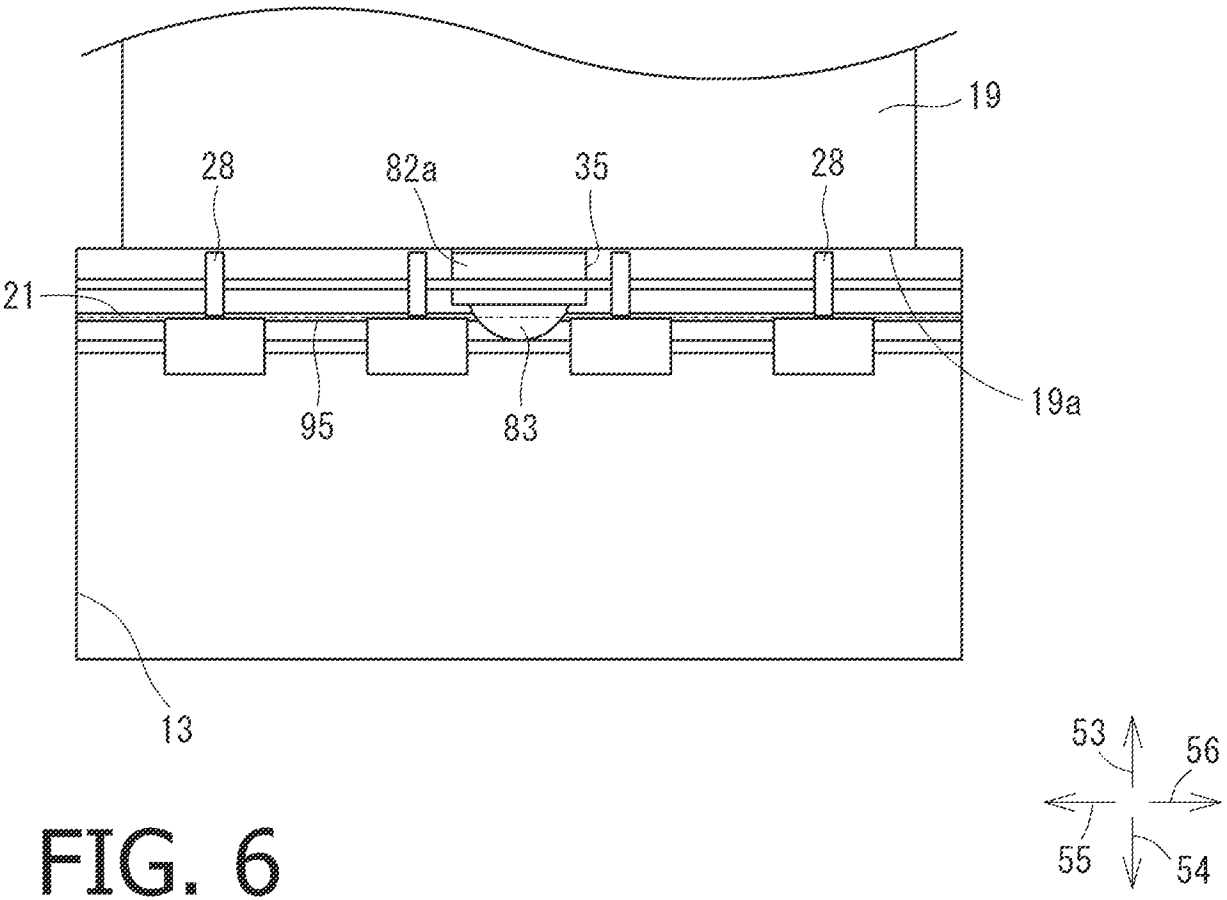
FIG. 6 shows a state where a cutter is exposed to the outside of a housing through an opening and an internal space of the image recording apparatus.

As shown in FIGS. 2 and 4, ahead of the recording device 17, the cutting device 45 is disposed above the conveyance path 21. The cutting device 45 is, when stopped, located in a stop position that is leftward of an image recording area A1. As shown in FIG. 6, the cutting device 45 is located in a middle position of the conveyance path 21 in the left-right directions 55 and 56 at a replacement time (described below) when a cutter 83 is replaced. The image recording area A1 is a maximum width within which image recording is executable by ejecting ink from the recording head 37 reciprocating together with the carriage 35. If a maximum size of the recording sheets 16 on which image recording is executable by the print engine 11 is A4, the image recording area A1 may be wider than the width of the A4 size in the left-right directions 55 and 56.

Figure 5:
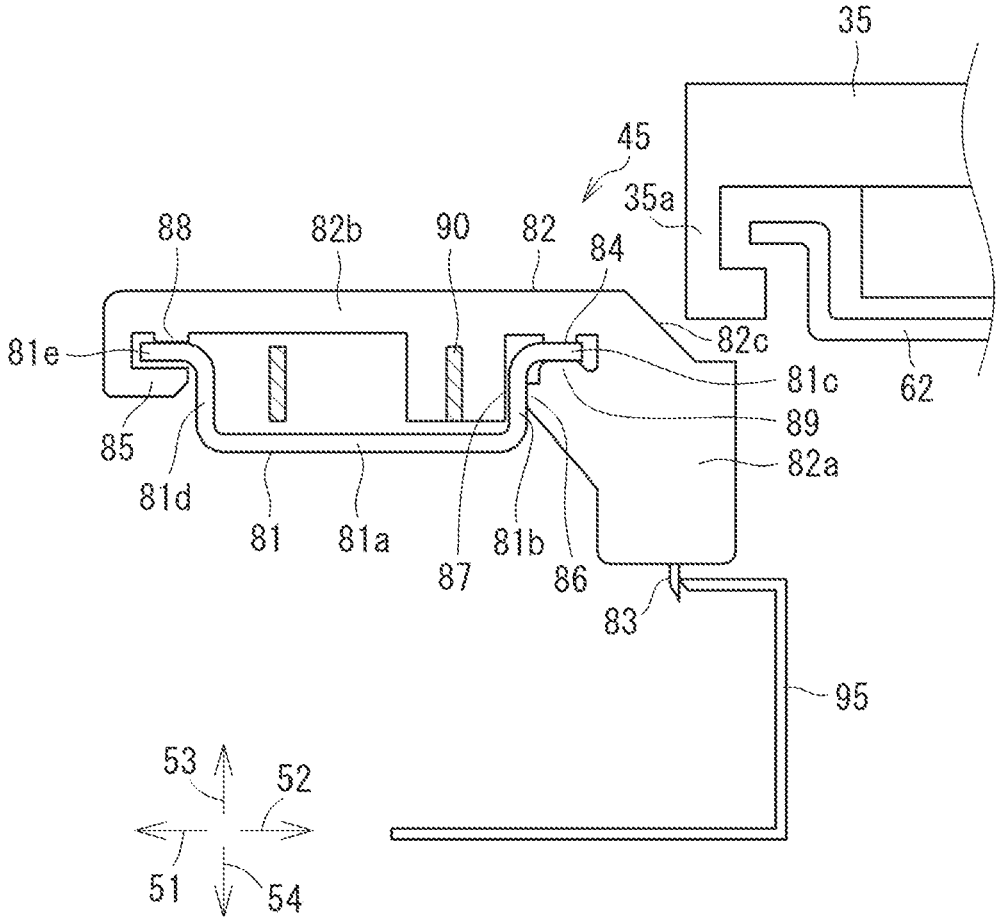
FIG. 5 is a side view showing a cutting device of the image recording apparatus.

The cutting device 45 is configured to cut the recording sheet 16 conveyed by the sheet conveyor 43 along the left-right directions 55 and 56. More specifically, the cutting device 45 is configured to cut the recording sheet 16 by moving rightward from the stop position (i.e., the position of the cutting device 45 shown in FIG. 4) that is leftward of the image recording area A1. For instance, a single A4-size recording sheet 16 is cut into two A5-size recording sheets 16 by the cutting device 45. As shown in FIG. 5, the cutting device 45 includes a guide rail 81, a cutter carriage 82, the cutter 83, and a fixed blade 95. The guide rail 81 extends along the left-right directions 55 and 56. The cutter carriage 82 is configured to move while being guided by the guide rail 81. The cutter 83 is mounted on the cutter carriage 82. In FIG. 5, an endless belt 90 (described below) is shown in cross section, to make the configuration of the cutting device 45 easier to understand. In FIG. 2, the cutting device 45 is shown in a simplified form, with a detailed structure thereof omitted.

The guide rail 81 has a flat shape extending along the left-right directions 55 and 56. The guide rail 81 is longer than the conveyance path 21 in the left-right directions 55 and 56. Left and right end portions of the guide rail 81 extend outward from the image recording area A1. Both the end portions of the guide rails 81 in the left-right directions 55 and 56 are fixedly attached to side frames (not shown) that support rotational shafts of the second discharge rollers 28.

The guide rail 81 includes a base plate 81*a*, a first erecting plate 81*b*, a first extending plate 81*c*, a second erecting plate 81*d*, and a second extending plate 81*e*. The base plate 81*a* extends in the left-right directions 55 and 56. The first erecting plate 81*b* extends upward from a rear end of the base plate 81*a*. The first extending plate 81*c* extends rearward from an upper end of the first erecting plate 81*b*. The second erecting plate 81*d* extends upward from a front end of the base plate 81*a*. The second extending plate 81*e* extends frontward from an upper end of the second erecting plate 81*d*. The base plate 81*a*, the first erecting plate 81*b*, the first extending plate 81*c*, the second erecting plate 81*d*, and the second extending plate 81*e* are formed by bending a single rectangular steel plate.

The cutter carriage 82 includes a cutter holder 82*a* and a connecting section 82*b*. The cutter holder 82*a* is configured to hold the cutter 83. The connecting section 82*b* is configured to be connected with the guide rail 81. The cutter holder 82*a* is disposed rearward of the guide rail 81. It is noted that the cutter holder 82*a* may be disposed in front of the guide rail 81. The cutter holder 82*a* extends downward lower than the guide rail 81.

The cutter holding portion 82*a* has an inclined surface 82*c* at an upper portion of an outer surface. The inclined surface 82*c* faces backward and upward. As shown in FIG. 5, when viewed in the left-right directions 55 and 56, the inclined surface 82*c* overlaps a front end portion 35*a* of the carriage 35 in the vertical directions 53 and 54 and in the front-rear directions 51 and 52. Thereby, the image recording apparatus 10 is reduced in size in the vertical directions 53 and 54 and in the front-rear directions 51 and 52. Since the cutter holder 82*a* has the inclined surface 82*c*, a front portion (i.e., a portion close to the connecting section 82*b*) of the cutter holder 82*a* is increased in thickness and strengthened, in the vertical directions 53 and 54 and in the front-rear directions 51 and 52. Moreover, it is possible to reduce a gap between the cutter carriage 82 and the carriage 35.

The connecting section 82*b* extends forward from the cutter holder 82*a*, and is connected with the guide rail 81. The connecting section 82*b* has a first contact portion 84, a second contact portion 85, a third contact portion 86, a fourth contact portion 87, a fifth contact portion 88, and a sixth contact portion 89. The first contact portion 84 is configured to contact an upper surface of the first extending plate 81*c*. The second contact portion 85 is configured to contact a lower surface of the second extending plate 81*e*. The third contact portion 86 is configured to contact a rearward-facing surface of the first erecting plate 81*b*. The fourth contact portion 87 is configured to contact a frontward-facing surface of the first erecting plate 81*b*. The fifth contact portion 88 is configured to contact an upper surface of the second extending plate 81*e*. The sixth contact portion 89 is configured to contact a lower surface of the first extending plate 81*c*.

The guide rail 81 is in contact with the first contact portion 84 and the fifth contact portion 88, thereby supporting the cutter carriage 82 against a downward load. Thus, the cutter carriage 82 is positioned in the vertical directions 53 and 54. The guide rail 81 is in contact with the third contact portion 86 and the fourth contact portion 87, thereby positioning the cutter carriage 82 in the front-rear directions 51 and 52. When the cutter carriage 82 moves upward relative to the guide rail 81, at least one of the second contact portion 85 and/or the sixth contact portion 89 is (i.e., the second contact portion 85, or the sixth contact portion 89, or both the second contact portion 85 and the sixth contact portion 89 are) brought into contact with the guide rail 81. Thereby, it is possible to prevent the cutter carriage 82 from disengaging upward from the guide rail 81.

As shown in FIG. 4, the cutter carriage 82 is driven by a drive mechanism 101. The drive mechanism 101 includes a driving pulley 102, a driven pulley 103, and an endless belt 90 wound around the driving pulley 102 and the driven pulley 103. The driving pulley 102 and the driven pulley 103 are disposed at two end portions in the left-right directions 55 and 56, respectively, on the upper surface of the base plate 81*a*. Each of the driving pulley 102 and the driven pulley 103 is rotatable about an axis along the vertical directions 53 and 54. A driving force from a motor (not shown) is transmitted to the driving pulley 102. The endless belt 90 is connected with the cutter carriage 82, in front of the fourth contact portion 87 of the connecting section 82*b* of the cutter carriage 82. When the driving pulley 102 rotates, the endless belt 90 makes a circulating movement, and the driven pulley 103 is driven to rotate. In response to the circulating movement of the endless belt 90, the cutter carriage 82 reciprocates along the guide rail 81 in the left-right directions 55 and 56.

The cutter 83, supported by the cutter holder 82*a*, protrudes downward from a lower end of the cutter holder 82*a*. The cutter 83 is disk-shaped, and is rotatably supported by the cutter holder 8 with the front-rear direction 51, 52 as an axial direction. The cutter 83 is removably attached to the cutter holder 82*a*.

The fixed blade 95 is disposed below the cutter holder 82*a* of the cutter carriage 82. The fixed blade 95 is supported by a side frame (not shown) and extends across the image recording area A1 along the left-right directions 55 and 56. A cutting edge of the fixed blade 95 is in contact with the cutter 83 from behind. The recording sheet 16 is cut by being sandwiched between the cutter 83 and the fixed blade 95.

Layout

As shown in FIGS. 2 and 6, the cutter holder 82*a* and the cutter 83 are located behind the discharge rollers 28. The cutter holder 82*a* and the cutter 83 are located below the lower end 19*a* of the operation panel 19. The cutter holder 82*a* and the cutter 83 are exposed to the outside through the internal space 20*a* and the opening 13 in a state where the cutter holder 82*a* and the cutter 83 are located in a middle position of the conveyance path 21 in the left-right directions 55 and 56. Thereby, the user is allowed to visually recognize the cutter holder 82*a* and the cutter 83 through the opening 13 and the internal space 20*a*. In other words, the user is allowed to access the cutter holder 82*a* and the cutter 83 through the opening 13 and the internal space 20*a* to replace the cutter 83. It is noted that when the cutting device 45 is in the stop position, the cutter holder 82*a* and the cutter 83 may be exposed to the outside through the internal space 20*a* and the opening 13 in such a manner that the user is allowed to replace the cutter 83. In another instance, only the cutter 83 may be exposed to the outside through the internal space 20*a* and the opening 13.

The following provides an explanation of how the image recording apparatus 10 cuts one A4-size recording sheet 16 into two A5-size recording sheets.

When the pick-up roller 32 rotates, a topmost one of A4-size recording sheets 16 is fed from the sheet feed cassette 15 to the conveyance path 21. The recording sheet 16 fed from the sheet feed cassette 15 to the conveyance path 21 is conveyed to below the recording head 37 by the intermediate rollers 24 and the PF rollers 25. The recording sheet 16 conveyed to below the recording head 37 is supported from underneath by the platen 36. While the conveyance of the recording sheet 16 is stopped, the carriage 35 moves along the left-right directions 55 and 56 with ink being ejected from the recording head 37 onto the recording sheet 16. Thereby, a single pass of image is recorded on the recording sheet 16. The image recording on the recording sheet 16 is completed when the image recording apparatus 10 has performed image recording for a particular number of passes while repeatedly performing an operation of conveying and stopping the recording sheet 16. In this example, image recording for two A5-size recording sheets is performed on the single A4-size recording sheet 16. During the image recording, the recording sheet 16 that has passed over the platen 36 is conveyed to below the cutting device 45 by the first discharge rollers 27.

When the center of the recording sheet 16 in the conveyance direction is conveyed to below the cutting device 45, in response to the rotation of the driving pulley 102, the cutter carriage 82 moves rightward from the stop position (i.e., the position of the cutting device 45 shown in FIG. 4) along the guide rail 81. At this time, the first contact portion 84 and the fifth contact portion 88 of the cutter carriage 82 slide on an upper surface of the first extending plate 81*c* and an upper surface of the second extending plate 81*e* of the guide rail 81, respectively. The A4-size recording sheet 16 is pinched by the cutter 83 and the fixed blade 95, and is cut thereby along the left-right directions 55 and 56 into two A5-size recording sheets. The two A5-size recording sheets are discharged from the conveyance path 21 onto the sheet discharge tray 18 by the discharge rollers 28. At this time, the recording sheet 16 is guided toward the sheet discharge tray 18 by linear contact with the lower end of the rib 105 in the internal space 20*a*. As a result, the recording sheet 16 is supported on the sheet discharge tray 18 with a front portion of the recording sheet 16 having passed through the opening 13.

Next, a method for replacing the cutter 83 in the image recording apparatus 10 will be described.

First, when the user presses an input key indicating that it is time to replace the cutter 83 on the operation panel 19, the cutting device 45 moves from the stop position to the middle position of the conveyance path 21 in the left-right directions 55 and 56. As a result, the cutter holder 82*a* and the cutter 83 are exposed to the outside of the housing 20 through the opening 13 and the internal space 20*a* (see FIG. 6). Subsequently, the user pulls the sheet feed cassettes 14 and 15 forward to remove the sheet feed cassettes 14 and 15 from the housing 20. Thereby, a larger work space is secured in the internal space 20*a* of the housing 20. At this time, only the sheet feed cassette 15 may be pulled out of the housing 20. Next, the user accesses the cutter 83 while visually recognizing the cutter 83 through the opening 13 and the internal space 20*a*. At this time, when the user's arm contacts the rib 105, the rib 105 is rotated about the axis 105A to move from the hanging position to the contact position (see FIG. 3). Then, the user detaches the cutter 83 from the cutter holder 82*a* and removes the cutter 83 out of housing 20 through the internal space 20*a* and the opening 13. Thereafter, the user accesses the cutter holder 82*a* through the opening 13 and the internal space 20*a* while holding a new cutter 83, and attaches the new cutter 83 to the cutter holder 82*a*. Finally, the user inserts the sheet feed cassettes 14 and 15 into the internal space 20*a* of the housing 20 through the opening 13, and attaches the sheet feed cassettes 14 and 15 to the housing 20.

Operations and Advantageous Effects of Illustrative Embodiment

In the aforementioned image recording device 10, the cutter 83 is disposed below the operation panel 19, and is exposed to the outside of the housing 20 through the opening 13 formed in the front face of the housing 20. Hence, the user is allowed to visually recognize the cutter 83 through the opening 13. Therefore, the user is allowed to easily replace the cutter 83 through the opening 13. In addition, there is no need to form another opening for replacing the cutter 83 in the housing 20 separately from the opening 13. Thus, it is possible to achieve a simplified configuration of the image recording apparatus 10.

The aforementioned image recording apparatus 10 has the rib 105 that protrudes downward from the lower surface 71*a* of the upper wall 71. Therefore, when a recording sheet 16 with ink ejected thereon passes through the opening 13, the rib 105 prevents the recording sheet 16 from rubbing against the lower surface 71*a* of the upper wall 71 and from sticking to the lower surface 71*a* of the upper wall 71. Thus, the ink on the recording sheet 16 is prevented from adhering to the lower surface 71*a* of the upper wall 71. Further, the recording sheet 16 that has passed through the opening 13 is securely supported by the sheet discharge tray 18.

In the aforementioned image recording apparatus 10, the lower end of the rib 105 is movable from the hanging position to the contact position higher than the hanging position. Therefore, to keep the rib 105 from serving as a barrier when the user replaces the cutter 83 through the opening 13, the user may move the lower end of the rib 105 from the hanging position to the contact position. Moreover, when discharged by the discharge rollers 28, the recording sheet 16 comes into linear contact with the lower end of the rib 105. Therefore, it is difficult for the recording sheet 16 to come into surface contact with the lower surface 71*a* of the upper wall 71. Thus, the ink on the recording sheet 16 is prevented from adhering to the lower surface 71*a* of the upper wall 71. Further, the recording sheet 16 is prevented from sticking to the lower surface 71*a* of the upper wall 71.

In the aforementioned image recording apparatus 10, the sheet discharge tray 18 is removably attached to the housing 20. Therefore, the user may remove the sheet discharge tray 18 from the housing 20, thereby securing a larger work space for replacing the cutter 83 in the internal space 20*a* of the housing 20. Thus, the user is allowed to safely and easily replace the cutter 83.

In the aforementioned image recording apparatus 10, the cutter 83 is located behind the discharge rollers 28. Therefore, the recording sheet 16 cut by the cutter 83 is smoothly discharged forward by the discharge rollers 28.

While aspects of the present disclosure have been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiment(s) according to aspects of the disclosure, as set forth above, are intended to be illustrative of the inventive concept, and not limiting the inventive concept. Various changes may be made without departing from the spirit and scope of the present disclosure. Therefore, the present disclosure is intended to embrace all known or later developed alternatives, modifications, variations, improvements, and/or substantial equivalents. Some specific examples of potential alternatives, modifications, or variations according to aspects of the disclosure are provided below.

Modifications

In the aforementioned illustrative embodiment, the cutting device 45 is configured to cut the recording sheet 16 by the cutter 83 and the fixed blade 95. However, the configuration of the cutting device 45 is not limited to a particular configuration as long as the cutting device 45 is configured to cut the recording sheet 16 along the left-right directions 55 and 56 and to expose the cutter 83 to the outside of the housing 20 through the opening 13. For instance, instead of the fixed blade 95, the cutting device 45 may have two disk-shaped rotatable blades like the cutter 83 that are mounted on the cutter carriage 82.

In the aforementioned illustrative embodiment, the cutting device 45 is configured to cut a standard-form rectangular recording sheet 16. However, the cutting device 45 may be configured to cut a medium pulled out from a roll body with a long medium wound in a roll shape into standard-form rectangular recording sheets 16.

In the aforementioned illustrative embodiment, the rib 105 is movable between the hanging position where the rib 105 hangs downward by gravity and the contact position where the rib 105 is brought into contact with the lower surface 71*a* of the upper wall 71 after rotating about the axis 105A from the hanging position. However, as shown in FIG. 7, the rib 105 may be movable between a protruding position where the rib 105 protrudes downward from the lower surface 71*a* of the upper wall 71 and a buried position where the rib 105 is buried in the upper wall 71.

In this case, the upper wall 71 may have a hole 106 formed in such a manner that the rib 105 is buried thereinto from below. A rear end of the rib 105 may be rotatable about an axis B extending in the left-right directions 55 and 56. The rib 105 may have a rotation-restricting mechanism configured to restrict the rib 105 from rotating downward from an orientation extending in the front-rear directions 51 and 52. For instance, the rotation-restricting mechanism may be configured to lock the rib 105 by an inner surface of the hole 106, although the configuration of the rotation-restricting mechanism is not limited to a particular configuration as long as the rib 105 is restricted from rotating downward from its orientation extending in the front-rear directions 51 and 52.

In the aforementioned illustrative embodiment, the cutter holder 82*a* is disposed behind the discharge rollers 28. However, as shown in FIG. 8, the cutter holder 82*a* may be disposed in front of the discharge rollers 28. In this case, the cutter 83 held by the cutter holder 82*a* is closer to the opening 13 than in the illustrative embodiment. This configuration facilitates replacement of the cutter 83 through the opening 13.

In the aforementioned illustrative embodiment, the sheet feed cassettes 14 and 15 are removed from the housing 2 when the cutter 83 is replaced. However, the sheet feed cassettes 14 and 15 may not be removed from the housing

20 if the cutter 83 is removable through the opening 13 and a space, above the sheet discharge tray 18, of the internal space 20*a*.

The following shows examples of associations between elements exemplified in the aforementioned illustrative embodiment and modifications, and elements according to aspects of the present disclosure. For instance, the image recording apparatus 10 may be an example of an "image recording apparatus" according to aspects of the present disclosure. The housing 20 may be an example of a "housing" according to aspects of the present disclosure. The operation panel 19 may be an example of an "operation panel" according to aspects of the present disclosure. The front-rear directions 51 and 52 may be included in examples of a "particular direction" according to aspects of the present disclosure. The front face of the housing 20 may be an example of "a first-side face of the housing" according to aspects of the present disclosure. The sheet conveyor 43 may be an example of a "sheet conveyor" according to aspects of the present disclosure. In this case, the pick-up roller 32, the two intermediate rollers 24, the two PF rollers 25, the two first discharge rollers 27, and the two second discharge rollers 28 may be included in the "sheet conveyor" according to aspects of the present disclosure. The conveyance path 21 may be an example of a "conveyance path" according to aspects of the present disclosure. The recording head 37 may be an example of a "recording head" according to aspects of the present disclosure. The cutting device 45 may be an example of a "cutting device" according to aspects of the present disclosure. The cutter 83 may be an example of a "cutter" according to aspects of the present disclosure. The opening 13 may be an example of a "sheet discharge port" according to aspects of the present disclosure. The sheet discharge tray 18 may be an example of a "sheet discharge tray" according to aspects of the present disclosure. The rib 105 may be an example of a "rib" according to aspects of the present disclosure. The hanging position, in which the rib 105 hangs downward by gravity as shown in FIG. 3, may be an example of a "first position" of the "rib" according to aspects of the present disclosure. In this case, the contact position, in which the rib 105 is brought into contact with the lower surface 71*a* of the upper wall 71 after rotating about the axis 105A from the hanging position, may be an example of a "second position" of the "rib" according to aspects of the present disclosure. In another instance, the protruding position, in which the rib 105 protrudes downward from the lower surface 71*a* of the upper wall 71 as shown in FIG. 7, may be an example of the "first position" of the "rib" according to aspects of the present disclosure. In this case, the buried position, in which the rib 105 is buried in the upper wall 71, may be an example of the "second position" of the "rib" according to aspects of the present disclosure. The second discharge rollers 28 may be included in examples of a "discharge roller" according to aspects of the present disclosure.

What is claimed is:

1. An image recording apparatus comprising:

a housing;

an operation panel disposed at a first-side face of the housing, the first-side face being a surface on a first side of the housing in a particular direction, the particular direction extending from the first side to a second side of the image recording apparatus;

a sheet conveyor configured to convey a sheet along a conveyance path in a conveyance direction;

a print head disposed downstream of the sheet conveyor in the conveyance direction, the print head being configured to eject print liquid onto the sheet;

a cutting device having a cutter disposed below the operation panel, the cutter being configured to cut the sheet; and a sheet discharge port that is open at the first-side face of the housing, the operation panel having a lower end that defines an upper end of the sheet discharge port, at least a part of the sheet passing through the sheet discharge port when the sheet is discharged from the conveyance path, the cutter being positioned below the lower end of the operation panel and exposed to an outside of the housing through the sheet discharge port.

2. The image recording apparatus according to claim 1, further comprising:

a sheet discharge tray configured to support the sheet discharged from the conveyance path; and a rib protruding downward from an upper surface, the upper surface defining an upper end of an internal space of the housing, the internal space extending from the sheet discharge port toward the second side of the image recording apparatus in the particular direction.

3. The image recording apparatus according to claim 2, wherein a lower end of the rib is movable to a first position and to a second position higher than the first position.

4. The image recording apparatus according to claim 2, wherein the sheet discharge tray is removably attached to the housing.

5. The image recording apparatus according to claim 2, wherein the sheet conveyor includes a discharge roller; and wherein the rib is closer to a first-side end of the sheet discharge tray in the particular direction than the discharge roller and cutter are, and the discharge roller is closer to the first-side end of the sheet discharge tray in the particular direction than the cutter is.

6. The image recording apparatus according to claim 5, wherein the rib is configured to rotate about an axis extending along the particular direction.

7. The image recording apparatus according to claim 1, wherein the sheet conveyor includes a discharge roller, and wherein the cutter is disposed closer to the second side of the image recording apparatus than the discharge roller is in the particular direction.

* * * * *